US005284088A

United States Patent [19]

Fantoni et al.

[11] Patent Number: 5,284,088

[45] Date of Patent: Feb. 8, 1994

[54] DEVICE FOR THE REGISTER ADJUSTMENT

[75] Inventors: Giuseppe Fantoni, Ozzano Monferrato; Mario Forno, Casale Monferrato; Gianfranco Gibellino, Trino Vencellese; Giampiero Miglietta, Casale Monferrato, all of Italy

[73] Assignee: Officine Meccaniche Giovanni Cerutti S.p.A., Italy

[21] Appl. No.: 973,741

[22] Filed: Nov. 9, 1992

[30] Foreign Application Priority Data

Mar. 23, 1992 [IT] Italy ..... MI92A-000659

[51] Int. Cl.[5] ..... B41F 13/06; B41F 5/04

[52] U.S. Cl. ..... 101/228

[58] Field of Search ..... 101/181, 248, 228, 219, 101/216; 226/34, 35, 21, 19, 28

[56] References Cited

U.S. PATENT DOCUMENTS 2,550,318 4/1951 Worthington et al. ..... 226/28

FOREIGN PATENT DOCUMENTS 3049078 7/1982 Fed. Rep. of Germany ..... 226/28

*Primary Examiner*—J. Reed Fisher

*Attorney, Agent, or Firm*—Kirschstein et al.

[57] ABSTRACT

In a printing machine, an arrangement for adjusting web register includes a frame detachably mounted on the machine, and a pair of guide rollers over which a web is guided. A downstream roller is raised and lowered, and both rollers, as well as a pair of frame members, are turned as a unitary assembly relative to the machine.

5 Claims, 3 Drawing Sheets

DEVICE FOR THE REGISTER ADJUSTMENT

BACKGROUND OF THE INVENTION

1. Field of the Invention

The present invention relates to a device for the register adjustment in the longitudinal direction and in the transverse direction of a web to be printed relative the impression cylinder of a rotary printing machine.

2. Description of Related Art

It is known that rotary printing machines have apparatuses for the register adjustment between two inking units.

The known apparatuses of this type consist essentially of a guide roller for the web of paper which is mounted in the side parts of the printing element, and a number of further horizontally arranged guide rollers are usually situated in the interior and are provided for other tasks. The guide roller of the register adjustment device which becomes effective in the longitudinal direction of the web to be printed is mounted so as to be adjustable in height relative to the frame of the printing unit.

In order also to allow adjustment of the transverse register in the known machines, it is known to provide a further guide roller of the web of paper in the interior of the printing element. For the register adjustment, this guide roller executes a pivoting movement about an axis arranged perpendicular to the longitudinal axis of the guide roller.

It is understandable that the necessity of providing additional adjusting devices of known design in the interior of the machine frame of a printing element of a rotary printing machine besides a plurality of guide rollers which interact with other cylinders or rollers makes the arrangement and assembly of the register adjustment device difficult, especially considering the fact that the space available in the interior of a printing element is extremely limited.

Moreover, carrying out maintenance or repair work in the interior of a printing element is not easy, on the one hand because the apparatuses for the register adjustment in the longitudinal direction and in the transverse direction are arranged in the interior of the printing element between additionally required rollers or cylinders, and the device for adjusting the register in the longitudinal direction is arranged mechanically and functionally separate from the roller for adjusting the transverse register. It should also be pointed out that the assembly of the known apparatus, its maintenance and any repair work or assembly processes, for example for exchanging the devices, can only be carried out in an extremely complicated manner.

SUMMARY OF THE INVENTION

The object of the present invention is to avoid the disadvantages of the prior art and to propose a single compact device of modular construction both for adjusting the longitudinal register and for adjusting the transverse register in a web to be printed relative to an impression cylinder and to allow adjustment of the longitudinal register as well as adjustment of the transverse register to be implementable with the assistance of a single guide roller for the web to be printed, and furthermore to make it possible to arrange the register adjustment device as a single compact constructional unit on the frame of a printing element and thereby to allow simple and unimpeded accessibility for carrying out maintenance work, adjustment work and repair work and, in the case of serious interferences occurring, to open up the possibility of demounting the entire register adjustment device in total within a short by virtue of its compact and modular construction and to allow assembly of a replacement device with a new register adjustment device and thereby to restrict the stoppage time of the printing machine considerably.

The object according to the invention is achieved in that the device for the register adjustment consists of lateral bearings which are connected to the frame of the printing element, in that a frame is arranged between these bearings which receives a guide cylinder which is displaceable in a controlled manner in a vertical plane, in that the frame receives a further guide cylinder in a stationary position, and in that pivot bearings are arranged between the lateral bearings and the frame for receiving the guide cylinders, and the frame is connected to a controllable pivoting device.

With a device of this type, an apparatus for register adjustment is provided which has a compact, modular type of construction and opens up the possibility of imparting both a controlled longitudinal movement and a controlled pivoting movement to the two guide rollers for the register adjustment and thereby of providing the possibility that the register adjustment can take place both in the longitudinal direction and in the transverse direction between two ink dots with the assistance of only two guide rollers. The subject matter of the invention is now described in more detail and illustrated in the drawings with reference to an exemplary embodiment.

DETAILED DESCRIPTION OF THE PREFERRED EMBODIMENT

Figure 1:
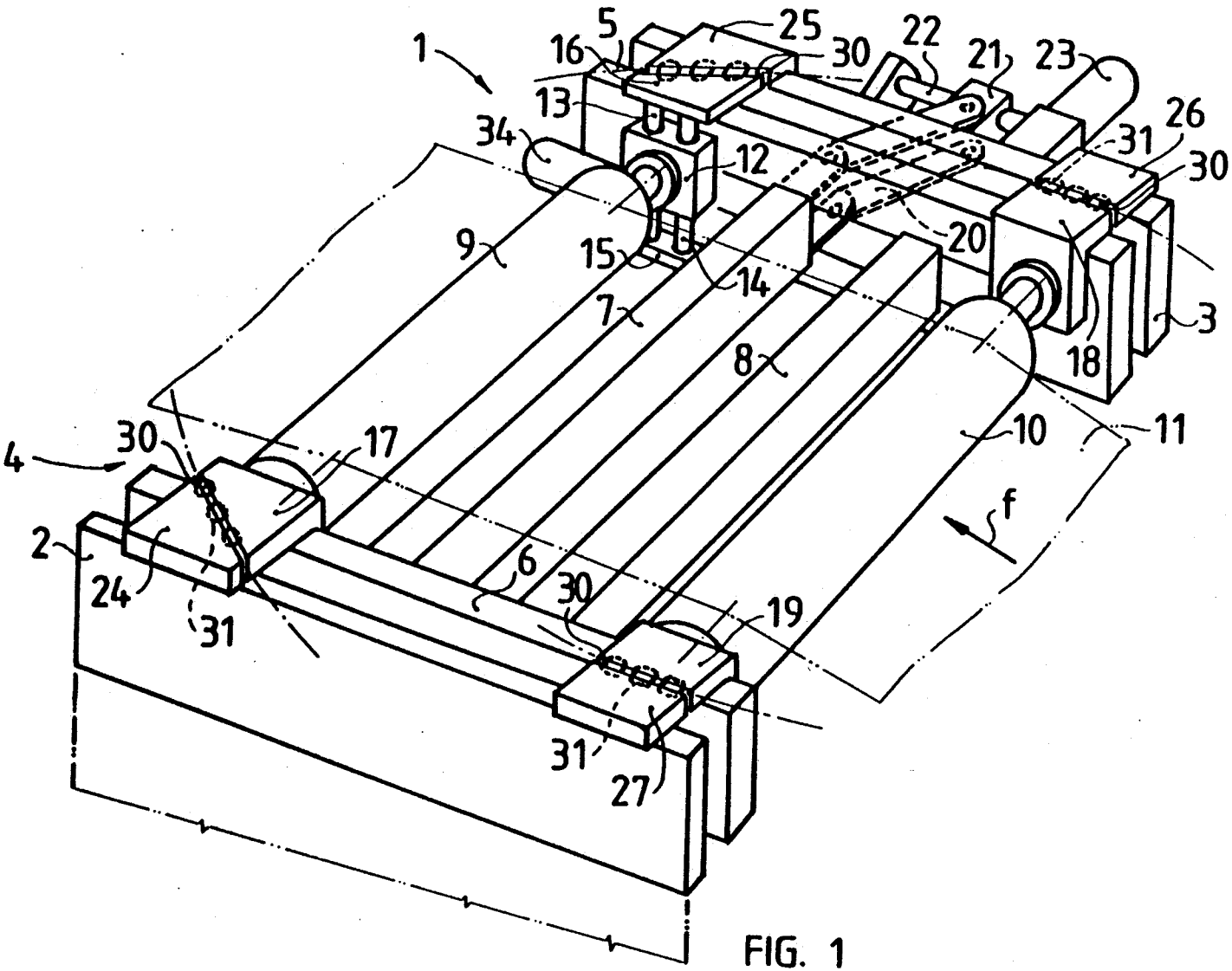
FIG. 1 shows a perspective of the new device for register adjustment, connected to the side walls of a printing element.

As can be seen in FIG. 1, the device denoted in total by 1 for register ad3ustment consists of two lateral bearings 2 and 3 which are fixedly connected to the wall parts of a printing element (not illustrated). Arranged between the bearings 2 and 3 is a stable frame which is denoted in total by 4.

The frame 4 consists of two struts 5 and 6 which are arranged parallel to the bearings 2 and 3 and are connected to one another by means of cross struts 7 and 8. Arranged parallel to the cross struts 7 and 8 are rollers 9 and 10 which serve as guide rollers for the web of paper or another material to be printed which can usually be used in rotary printing machines. The guide rollers 9 and 10 are mounted so as to be freely rotatable in the frame 4 and allow the web of paper 11 unimpeded movement in the direction of the arrow f. The front guide roller 9 is mounted at both ends so as to be freely rotatable in a bearing block 12. Each bearing block 12 is received, so as to be displaceable, by a vertically arranged guide column 13; furthermore, the bearing block 12 is operatively connected to an adjusting screw 14.

The upper and lower ends of each guide column 13 and of the associated adjusting screw 14 are received by holding plates 15 and 16. The holding plates are connected to the struts 5 and 6 of the frame 4. A further description of these components is given in the following text.

The guide roller 10 arranged at the rear is also mounted in receiving plates 18 and 19.

It can be seen in FIG. 1 that, with the assistance of lifting gears 20 which can be of different design, the frame 4 is connected to an actuating device 21 which is operatively connected to a drive screw 22, the drive screw 22 being drivable via a controllable motor 23. This device is mounted in total on the outside of the bearing 3.

The bearing plates 16 and 17 as well as 18 and 19, together with plate-shaped components 24, 25 and 26, 27 which are connected to the bearings 2 and 3, form ball or rolling bearings in order thus to allow precise movement of the frame 4 relative to the bearings 2 and 3. For this purpose, slide paths 30 are formed between the bearing plates 16, 25, 17, 24, 18, 26 and 19, 27. Rolling means, for examples balls or rollers 31, are inserted between the paths 30. Even if, for reasons of drawing simplification, the run-off paths are illustrated by straight lines, it has to be pointed out that these 35 rolling paths 30 have a curved course with a very large radius of curvature, as a result of which a precise pivoting movement of the frame 4 in a horizontal plane relative to the lateral bearings 2 and 3 is possible.

The web 11 to be printed, which runs in the direction of the arrow f, arrives at the front roller 9 after running over the guide roller 10. Each end journal of the cylinder 9 is received by a bearing block 12, and each bearing block 12 is arranged so as to be displaceable in the vertical direction on a guide column 13 which is connected to the holding plates 15 and 16.

Additionally connected to the holding plates 15 and 16 is a drive screw 14 which is operatively connected to the bearing block 12. One end of the drive screw 14 is operatively connected to the drive shaft (not illustrated) of a reducing geare 32, the drive shaft 33 of the transmission being operatively connected to a drive motor 34.

The drive motor 34 is constructed in an advantageous manner as a known DC motor which is controllable in a simple manner. Assigned to the motor 34 and the drive screw 14 is a position recognition means, for example an encoder or a similar unit (not illustrated), as a result of which it is possible, using known means which are commercially available, to establish the respective position of the guide roller 9 relative to the frame 4 with accuracy.

Figure 2:
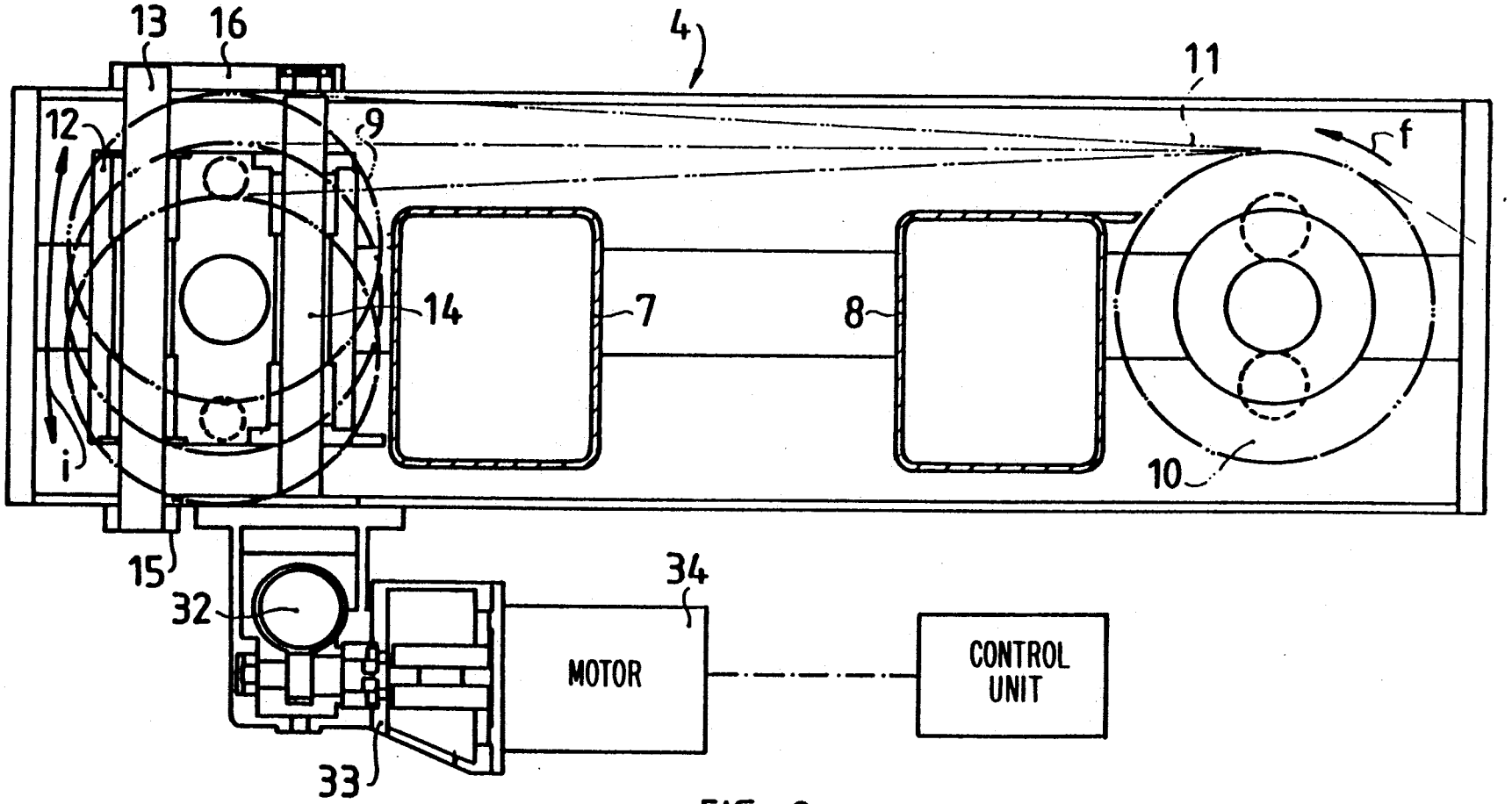
FIG. 2 shows a diagrammatic side view of the device according to the invention to illustrate the device for adjusting the register in the longitudinal direction.

In FIG. 2, the guide roller 9 and the web of paper illustrated by dot/dashed lines are in a different height arrangement, which can be equated with different register adjustments in the longitudinal direction.

Figure 3:
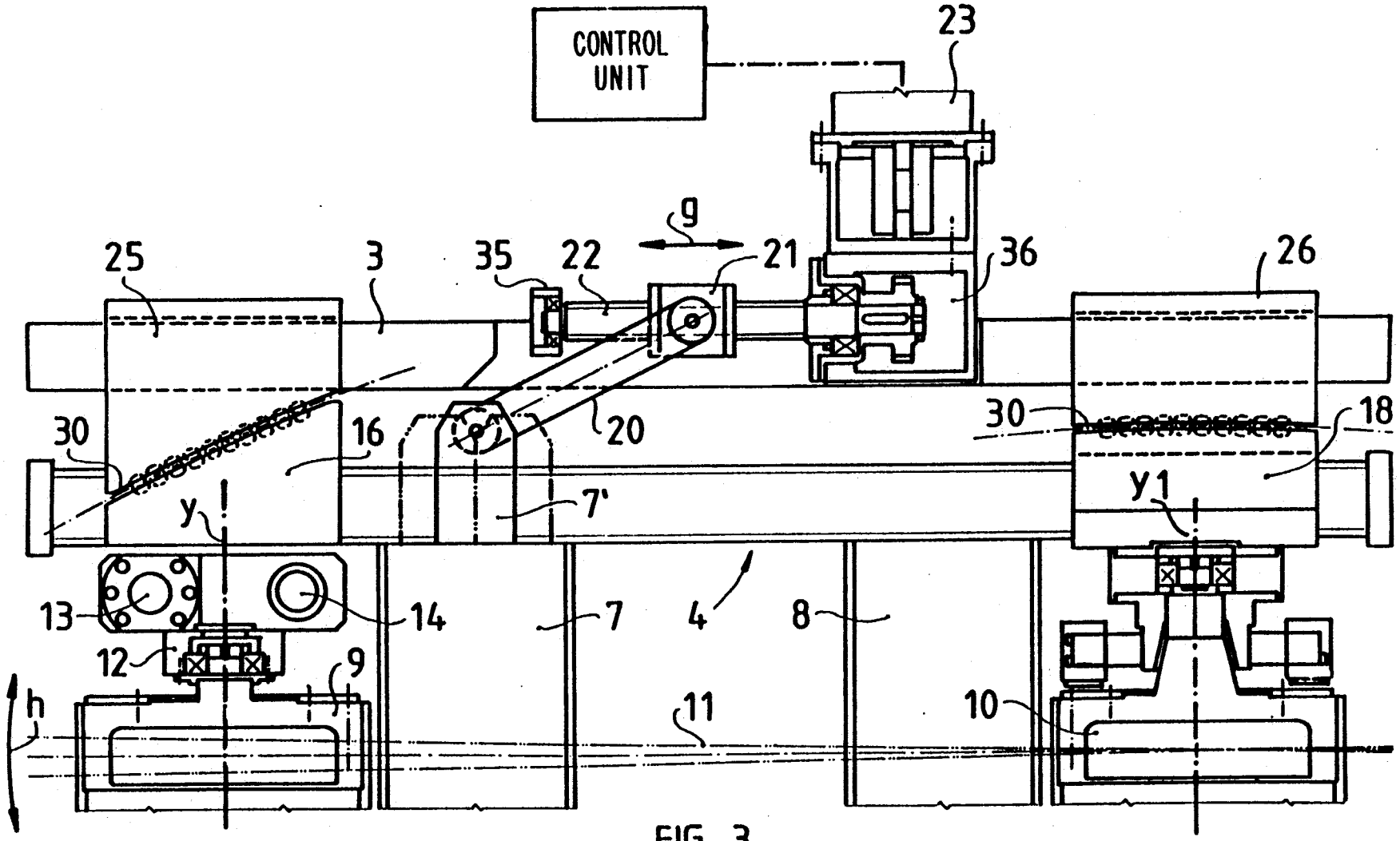
FIG. 3 shows a diagrammatic plan view of part of the device according to the invention to illustrate the apparatuses for register adjustment in the transverse direction.

One side of the frame 4 can be seen in a plan view in FIG. 3. In this drawing, it can be seen, in particular, that the bearing 3 which is connected to the wall of a printing element located below it is connected to a bearing 35 which receives a threaded spindle 22 which is arranged rotatably and is connected with its other end to a reducing gear 36 which is driven by a motor 23. The drive motor 23 is constructed in an advantageous manner as a DC motor and can thus be controlled in a simple manner. Furthermore, a position indicating means, for example an encoder (not illustrated), can be assigned to the motor 23 or the screw 22, by means of which the local position of a drive carriage which is operatively connected to the screw 22 can be indicated precisely. Operatively connected to the carriage 21 is a lever transmission 20 which is connected in an articulated manner to the frame 4, in the example illustrated, by the arm 7, which projects from the strut 7.

By controlled displacement of the carriage 21 in the direction of the arrow (g), it is possible to pivot the frame 4 in the horizontal plane (drawing plane). By means of this pivoting movement, which is possible due to the curved course of the rolling paths 30 of the bearings 16 and 25 as well as 18 and 26, the possibility is opened up of changing the position of the axes Y-Y1 or of the guide rollers 9 and 10 relative to the bearings 2 and 3 which receive the frame 4.

Consequently, as illustrated in the drawing by dot/-dashed lines, the running direction of the web to be printed is changed in the horizontal plane, which means that register adjustment of the web 11 in the transverse direction is possible, as is illustrated by the arrow (h) in FIG. 3.

The mode of functioning of the device 1 according to the invention is as follows:

If a change of the register adjustment in the longitudinal direction is desired, it is sufficient to actuate the motor 34 by hand or automatically, for example via an actuating key or a control unit, units which are operatively connected to the motor.

This leads to the front guide roller 9 being displaced upwards or downwards, as is indicated by the arrow (i) in FIG. 2. By virtue of providing a reducing gear 32, the displacement in the direction of the arrow (i) takes place with the smallest division, which provides the possibility of undertaking adjustment of the register in the longitudinal direction of the web of paper 11 with the highest precision.

If, in contrast, the motor 23, to which the carriage 21 of the frame 4 is assigned, is actuated, register adjustment can take place in the transverse direction of the web of paper 11 (arrow h in FIG. 3).

By virtue of providing a reducing gear 36, this register adjustment also allows adjustment of the transverse register with the greatest precision. The motor 23 can also be actuated by hand or, via control signals which are relayed, for example, by a control unit, the actuation of the motor can also take place automatically.

The apparatus 1 according to the invention for adjusting the register has the advantage that it consists of an extremely compact and modular-type structure, which allows the adjustment of the device 1 on the upper side of the frame of any printing element. Furthermore, the device 1 according to the invention is distinguished by increased functional efficiency by virtue of using functionally reliable components.

In the case of damage occurring, it is possible to carry out the repair work conveniently on the outside of the respective printing element without the necessity of having to remove cylinders or groups of rollers, which are provided for other functions, in the interior of the frame of the printing element. If it should prove impossible for the repairs to be carried out within a short time, it is possible for the device 1 to be demounted in total and replaced by a new device 1 for register adjustment. The stoppage times of the printing machine are thus reduced to a minimum.

We claim:

1. An arrangement for adjusting web register in a printing machine, comprising:

(a) a frame detachably mounted on the machine, said frame having a pair of frame members extending in mutual parallelism along a longitudinal direction, and spaced apart along a transverse direction generally perpendicular to the longitudinal direction;

(b) a pair of guide rollers over which a web is sequentially guided along a path to a printing station, said guide rollers extending along the transverse direction between the frame members and being spaced apart along the longitudinal direction, said guide rollers being journaled for rotation about respective axes lying in a common plane;

(c) elevation means for raising and lowering a downstream one of the guide rollers for movement in an elevation direction generally perpendicular to both the transverse and longitudinal directions; and (d) means for turning the guide rollers and the frame members as a unitary assembly relative to the machine in a curved course in said common plane.

2. The arrangement according to claim 1, wherein the frame includes cross members spaced apart along the longitudinal direction, and extending along the transverse direction to the frame members.

3. The arrangement according to claim 1, wherein said one downstream roller has one end journaled in a bearing block having a pair of passages extending therethrough along the elevation direction; and wherein the elevation means includes a guide column extending through one of the passages and having opposite column ends secured to one of the frame members; a screw in driving engagement with, and extending through, the other of the passages; and a drive motor in force-transmitting relationship with the drive screw to adjust the elevation of the bearing block and said one downstream roller.

4. The arrangement according to claim 1, wherein each roller has opposite ends operatively connected to respective frame plates mounted on respective frame members, and wherein the turning means includes machine plates mounted on the machine, each machine plate being generally co-planar with a respective frame plate and bounding a curved passageway therewith; and wherein the turning means further includes ball bearings in each curved passageway.

5. The arrangement according to claim 4, wherein the turning means further includes a drive motor in force-transmitting engagement with a drive screw along which a carriage is mounted, and a linkage operatively connected between the frame and the carriage.

* * * * *